United States Patent [19]

Lee et al.

[11] Patent Number: 4,608,894

[45] Date of Patent: Sep. 2, 1986

[54] ADHESIVE TAPE-CUTTING DEVICE

[76] Inventors: Ki S. Lee; Song J. Kim; Hyok Lee; Kwang U. Lee, all of 901-6, Shiheung-dong, Guro-ku, Seoul, Rep. of Korea

[21] Appl. No.: 577,808

[22] Filed: Feb. 7, 1984

[30] Foreign Application Priority Data

Feb. 9, 1983 [KR] Rep. of Korea ..... 83-1158[U]

[51] Int. Cl.[4] ..... B23D 25/02; B26D 1/62

[52] U.S. Cl. ..... 83/322; 83/345; 83/649; 83/674; 83/922

[58] Field of Search ..... 30/205, 124, 175; 83/155, 322, 325, 326, 334, 335, 345, 346, 649, 922, 674; 221/30

[56] References Cited

U.S. PATENT DOCUMENTS 2,274,623 2/1942 Hawkins ..... 83/322

3,802,309 4/1974 Bosland ..... 83/649 X 4,385,479 5/1983 Focke ..... 83/325

*Primary Examiner*—Douglas D. Watts

*Attorney, Agent, or Firm*—Antonelli, Terry & Wands

[57] ABSTRACT

An adhesive tape cutting device is described. The device comprises a plurality of projections for progressively engaging the tape to unroll it. A concavity is formed on each projection between a pair of tape contacting parts on the top face of the projection. One of the contacting parts is higher than the other and cooperating with an adjacent role carrying a cutter blade to automatically rotate the roller in the movement of the projections for unrolling the tape whereby the cutter blade on the roller enters the concavity in a projection to cut the tape thereon. In a second embodiment the projections are on a belt and sloping projections can also be provided on the belt for engaging and rotating a roller carrying a cutter blade.

9 Claims, 10 Drawing Figures

ADHESIVE TAPE-CUTTING DEVICE

BACKGROUND AND SUMMARY OF THE INVENTION

The invention relates to an adhesive tape-cutting device in which many pieces of tape, as desired, can be cut to a needed regular length at one time.

In the present invention, an inclined concave part which holds the shaft on which a role of adhesive tape is set is formed at both side inner walls of the case respectively, and a roller having plural projections each provided with a concavity for receiving a tape-cutter is set so as the tip part of said tape roll can be adhered on the said projections, and a roller having the cutters which are designed to meet with respective concavity above and to cut said tape is set.

In a conventional adhesive tape-cutter, the adhesive tape is cut by a cutter having sawteeth shape and formed with the tape case so that the adhesive tape can not be cut very quickly, thus the user has to cut said adhesive tape in proper quantity in advance when having time, and furthermore, the user has to cut said adhesive tape by hand.

On the contrary, in the present invention, many needed pieces of adhesive tape of uniform length can be cut at a time automatically and freely by means of letting the tip part of said tape roll adhere on the projections formed on the roller. The fine cut achieved with the device of the invention is to be contrasted with that attained in a conventional adhesive cutter wherein a sawtooth shaped cutter results in a cut edge which is bad looking for packing use.

Figure 4:
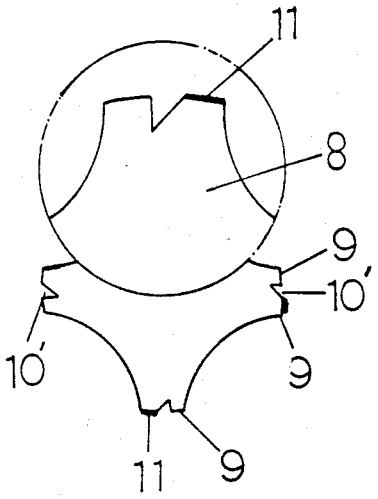
FIG. 4 is also another type of roller in the invention.

Referring now to the drawings, an inclined concavity 2 is formed at both side inner walls of the case 1, and a shaft 3 is rotatably supported at the lower end of each concavity 2, and a plurality of rolls of adhesive tape 4 are set on said shaft 3, and a roller 6 having plural cutters 5, 5' thereon is also provided along with a fellow roller 7 having a plurality of projections 8 thereon. A concavity 10 or a V-shaped concavity 10' is formed at the top of each projection 8 with one side contacting part having convex lines 11 of each concavity 10, 10' being made higher than the other side contacting part 9 as shown in FIG. 4, and the top face of the other side contacting part 9' being formed to be inclined.

Figure 1:
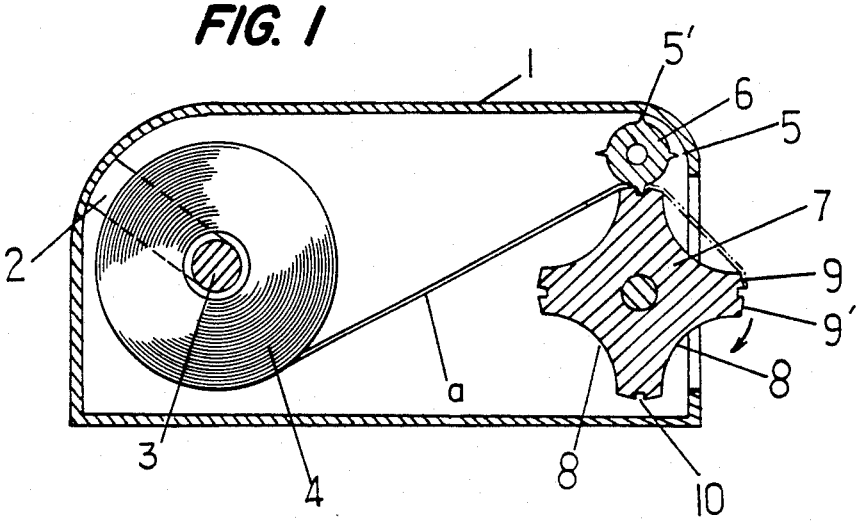
FIG. 1 is a sectional view of the invention.
Figure 2:
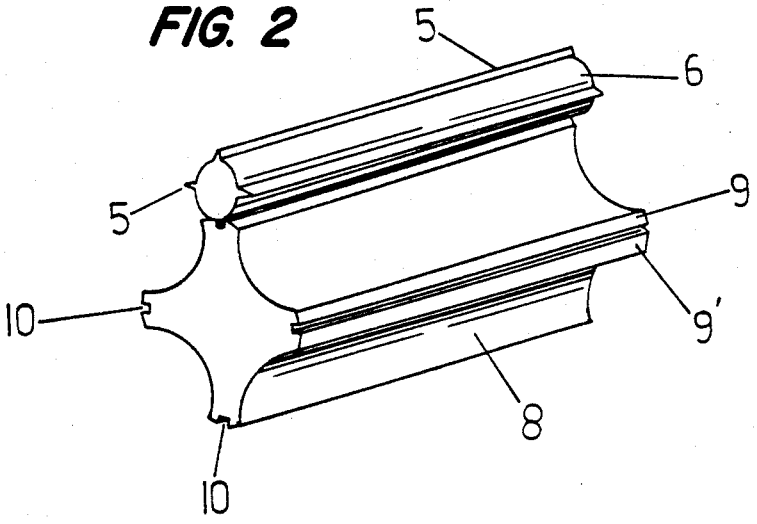
FIG. 2 is a perspective view of the main part in the invention.
Figure 3:
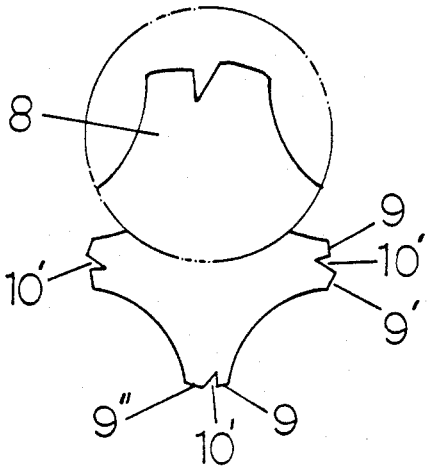
FIG. 3 is another type of roller in the invention.

By way of explanation of the action and the effect of the invention it is noted that the fellow roller 7 is rotated by means of pushing one of projections 8 forward in the direction of the arrow shown in FIG. 1, and at this time, the tip part of the adhesive tape 4 which is adhered on the top face of the said two parts 9, 9' formed by the concavity 10 or 10' can be pulled out and the roller 6 is rotated automatically and one of cutters 5 is moved into a respective concavity 10 or 10' of the projections 8 to cut the adhesive tape 4 and the user can use the cut-tape.

In the present invention, many rolls of the adhesive tape 4 can be set onto the shaft 3 so that the user can prepare many pieces of cut-adhesive tape for packing effectively, namely, the user can get the cut-adhesive tape easily even if many customers come. Further, the user can get the cut-adhesive tape without the cut ends having a sawtooth appearance as produced by conventional tape cutters.

And the users can remove the cut-adhesive tape easily since the tip part of the adhesive tape 4 is cut in a state that the tip part of said tape is adhered on the inclined face 9'' having plural convex lines 11 and some part of the tip part of said adhesive tape 4 is adhered on the opposite top face 9 of the projection 8.

Figure 5:
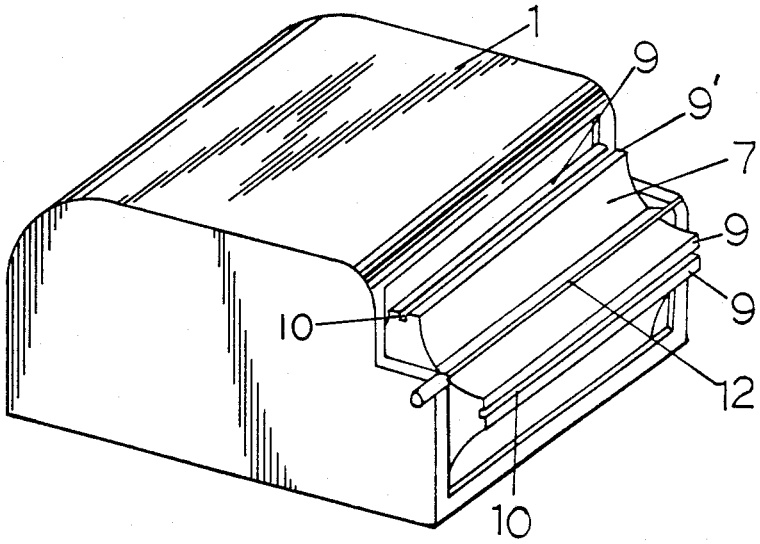
FIG. 5 is a perspective view showing the cutter which is set in a front site of the invention.

In the form of the invention shown in FIG. 5, the device does not use the roller 6 but a cutter 12 to cut the adhesive tape which is being adhered between the contacting parts of each projection. Otherwise the device in FIG. 5 is the same as that shown in FIG. 1.

Figure 6:
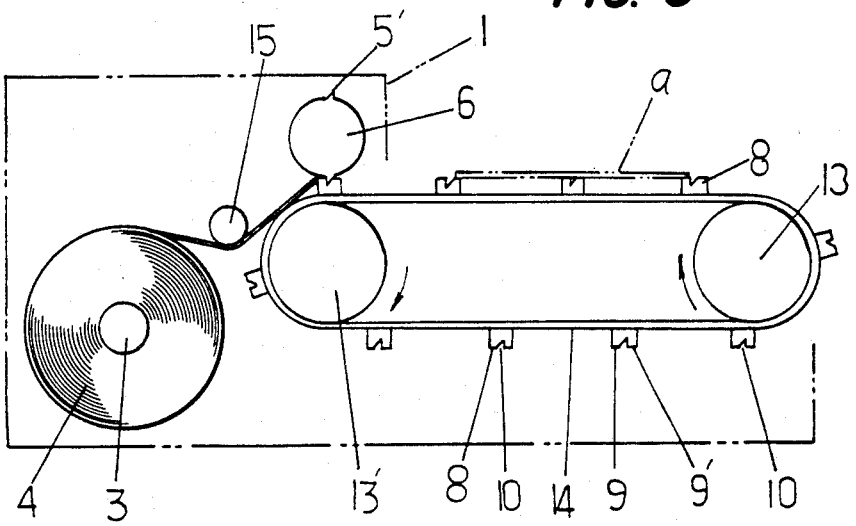
FIG. 6 is another type of cutting device in the invention.

As seen in FIG. 6, the adhesive tape rolls 4 are set onto the shaft 3, and plural projections 8 having concavities 10 are formed on a belt 14 which is rotated by the rotation of rollers 13 and 13'. The projections are to be situated at regular intervals on the belt 14 and the said tape can be cut by the cutters 5, 5' of the roller 6 when the cutters fall into the concavities, and a pressing roller 15 is set for the purpose of pressing the unrolled tape to be adhered on the top face of the projection 8 in order to keep the cut-tape a on said projections.

Figure 7:
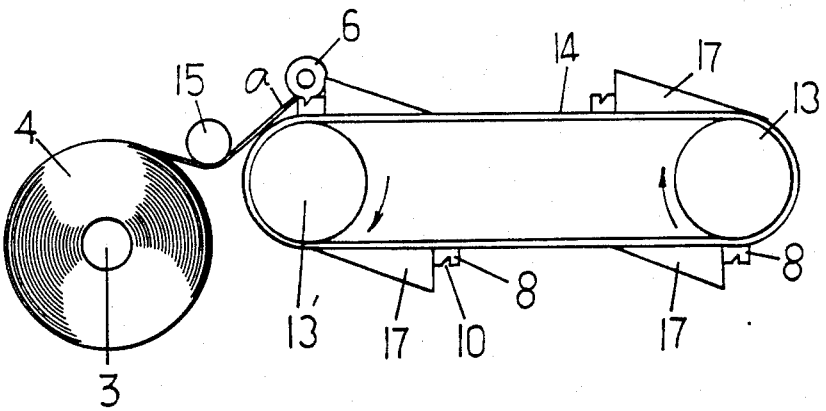
FIG. 7 is a view showing the cutter of FIG. 6 having the slope at its front site.
Figure 8:
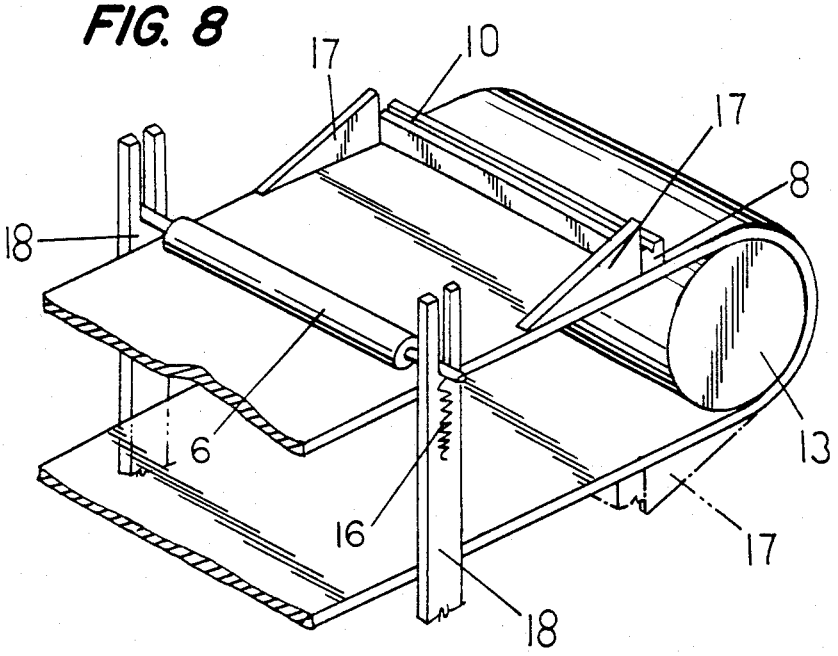
FIG. 8 is a view showing the roller of FIG. 6 in wh9ch a spring is connected with said roller and FIG. 9A and FIG. 9B are views showing the solenoid actuated cutter according to the invention.
Figure 9A:
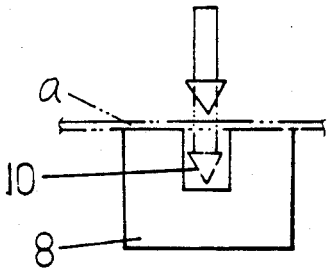
Figure 9B:
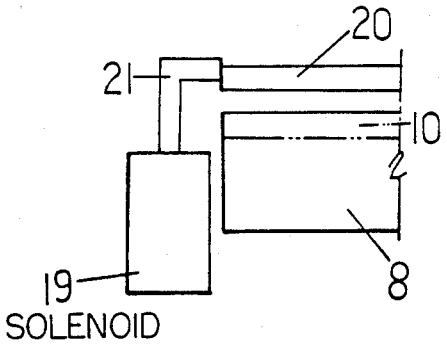

As seen in FIG. 7 through FIG. 9, sloping projections 17 are formed at the belt 14 to be close by the projections 8 for the purpose of letting the tape be cut by the cutter when said cutter falls into the said concavity 10 from the said sloping projection 17 under the pulling action of the roller 6 downward by springs 16. The roller 6 is moved by the sloping projections 17 and the spring 16 along a guide of a holder 18 on which the roller 6 is mounted.

As seen in FIGS. 9A and B, an acting bar 21 is moved downward by the electrical action of a solenoid 19, and at the same time, a cutter 20 connected to the bar 21 moves downward and into the concavity 10 so that the tape can be cut.

As seen from the above explanation, the present invention has the effect of cutting the plurally set adhesive tapes in large quantity in a short period of time and without any trouble. This is advantageous because the user can obtain cut-adhesive tapes in large quantity for busy packing.

We claim:

1. An adhesive tape-cutting device comprising means for rotatably supporting a roll of tape so that said roll can be unrolled therefrom, means for unrolling tape from a roll of tape supported by said means for supporting, said means for unrolling including a plurality of projections which are progressively moved into contact with said tape at spaced intervals along said tape during movement of said means for unrolling to unroll tape from said roll, each of said projections including a pair of tape contacting parts spaced apart on the top face of the projection in the direction of movement of said projection by a concavity, and cutting means cooperating with said unrolling means for cutting the tape unrolled by said means for unrolling, said cutting means including a roller located adjacent said unrolling means, said roller having at least one cutter blade on its outer periphery which is adopted to project into the concavity in a projection of said unrolling means to cut the unrolled tape on said projection, wherein one of said tape contacting parts on each of said projections is made higher than the other contacting part thereon so that said one tape contacting part drivingly contacts the outer periphery of the roller of said cutting means to thereby automatically rotate the roller of said cutting means with movement of said unrolling means to move said cutter blade on said roller into a concavity of a projection and cut said tape.

2. An adhesive tape-cutting device according to claim 1, wherein said concavity is V-shaped in cross section taken along the direction of movement of said projection.

3. An adhesive tape-cutting device according to claim 7, wherein said projections are formed on the outer periphery of a roller which is rotatably mounted.

4. An adhesive tape-cutting device according to claim 1, wherein said one of said contacting parts of each projection which is higher than the other contacting part is the leading contacting part in the direction of movement of said projection and is inclined in said direction of movement.

5. An adhesive tape-cutting device according to claim 7, wherein said means for rotatably supporting a roll of tape includes a shaft on which a roll of tape is supported and an inclined concavity formed at both of opposed inner walls of a case of said device, said shaft being supported at respective ends thereof at the lower end of each inclined concavity.

6. An adhesive tape-cutting device comprising means for rotatably supporting a roll of tape so that said tape can be unrolled therefrom, means for unrolling tape from a roll of tape supported by said means for supporting, said means for unrolling including a plurality of projections which are progressively moved into contact with said tape at spaced intervals along said tape during movement of said means for unrolling to unroll tape from said roll, each of said projections including a pair of tape contacting parts spaced apart on the top face of the projection in the direction of movement of said projection by a concavity, and cutting means cooperating with said unrolling means for cutting the tape unrolled by said means for unrolling, said cutting means including at least one cutter blade adapted to be moved into the concavity in a projection of said unrolling means to cut the unrolled tape on said projection, wherein said projections are formed in spaced relationship on a belt which is mounted for rotation.

7. An adhesive tape-cutting device according to claim 6, wherein said cutting means includes a roller, said at least one cutter blade being provided on the outer periphery of said roller, and wherein a plurality of sloping projections are formed on said belt between respective ones of said plurality of projections having concavities therein, said sloping projections progressively engaging and rotating said roller of said cutting means with movement of said unrolling means to cut the unrolled tape on the projections having concavities.

8. An adhesive tape-cutting means according to claim 7, wherein said roller is mounted in guide means at its respective ends for movement toward and away from said belt, spring means being provided to bias said roller in said guide means towards said belt.

9. An adhesive tape-cutting device according to claim 6, wherein said at least one cutter blade is actuated by a solenoid.

* * * * *